US011112707B2

(12) United States Patent
Takahashi et al.

(10) Patent No.: US 11,112,707 B2
(45) Date of Patent: Sep. 7, 2021

(54) ELECTROPHOTOGRAPHIC PHOTOSENSITIVE MEMBER, PROCESS CARTRIDGE, AND ELECTROPHOTOGRAPHIC APPARATUS

(71) Applicant: CANON KABUSHIKI KAISHA, Tokyo (JP)

(72) Inventors: Koji Takahashi, Kashiwa (JP); Akifumi Matsubara, Kashiwa (JP); Yuya Chimoto, Funabashi (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/745,459

(22) Filed: Jan. 17, 2020

(65) Prior Publication Data

US 2020/0241434 A1 Jul. 30, 2020

(30) Foreign Application Priority Data

Jan. 24, 2019 (JP) ..... JP2019-010493

(51) Int. Cl.
*G03G 5/147* (2006.01)
*G03G 15/00* (2006.01)
*G03G 21/18* (2006.01)

(52) U.S. Cl.
CPC ..... *G03G 5/14704* (2013.01); *G03G 5/1476* (2013.01); *G03G 15/75* (2013.01); *G03G 21/1803* (2013.01)

(58) Field of Classification Search
CPC ..... G03G 5/14704
See application file for complete search history.

(56) References Cited

U.S. PATENT DOCUMENTS 5,399,452 A * 3/1995 Takegawa ..... G03G 5/0596 430/56
6,664,014 B1 * 12/2003 Kikuchi ..... G03G 5/14704 430/66

(Continued)

FOREIGN PATENT DOCUMENTS

JP 2011-027807 2/2011
JP 2016-095340 5/2016

(Continued)

*Primary Examiner* — Christopher D Rodee
(74) *Attorney, Agent, or Firm* — Venable LLP

(57) ABSTRACT

The electrophotographic photosensitive member includes: a support; a charge-generating layer; and a charge-transporting layer, the charge-generating layer and the charge-transporting layer being arranged on the support, wherein a surface layer of the electrophotographic photosensitive member contains: inorganic particles having an average particle diameter (Lα) of primary particles of 5 nm or more and 50 nm or less; and resin particles having an average particle diameter (Lβ) of primary particles of 0.1 μm or more and 5.0 μm or less, and wherein in any cross-section of the surface layer, "(Smα)/(Sα)≥0.3" is satisfied, where a region within (Lβ/2) from a surface of each of the resin particles is defined as a region (M), a sum of cross-sectional areas of the inorganic particles in the any cross-section is represented by (Sα), and a sum of cross-sectional areas of the inorganic particles that are included in the region (M) is represented by (Smα).

6 Claims, 2 Drawing Sheets

(56) References Cited

U.S. PATENT DOCUMENTS

| | | | | |
|---|---|---|---|---|
| 9,766,560 | B2 | 9/2017 | Kurachi | |
| 10,261,430 | B2 * | 4/2019 | Chokan | G03G 5/14704 |
| 10,558,132 | B2 | 2/2020 | Ishiduka et al. | |
| 2004/0058828 | A1 * | 3/2004 | Iwata | C10M 111/04<br>508/104 |
| 2010/0129115 | A1 * | 5/2010 | Ishida | G03G 15/751<br>399/159 |

FOREIGN PATENT DOCUMENTS

| | | |
|---|---|---|
| JP | 2017-058524 | 3/2017 |
| JP | 2017-125946 | 7/2017 |

* cited by examiner

ELECTROPHOTOGRAPHIC PHOTOSENSITIVE MEMBER, PROCESS CARTRIDGE, AND ELECTROPHOTOGRAPHIC APPARATUS

BACKGROUND OF THE INVENTION

Field of the Invention

The present disclosure relates to an electrophotographic photosensitive member, and a process cartridge and an electrophotographic apparatus each including the electrophotographic photosensitive member.

Description of the Related Art

In recent years, as a result of progress in diversification of electrophotographic apparatus users, an image to be output has been required to have a higher image quality than in the related art and be free of a change in image quality during a use period.

In Japanese Patent Application Laid-Open No. 2017-58524, as a technology for improving wear resistance, there is a disclosure of a technology relating to an electrophotographic photosensitive member including a surface layer containing: a charge-transporting substance; surface-treated inorganic particles each having a high volume resistivity; and organic fine particles.

In addition, in Japanese Patent Application Laid-Open No. 2017-125946, as a technology for improving durability while maintaining a satisfactory cleaning property, there is a disclosure of the following technology. Metal oxide fine particles to be dispersed in a protective layer are treated with two kinds of surface treatment agents, and part of the metal oxide fine particles having the two kinds of surface treatment agents are held onto surfaces of fluorine resin fine particles, to thereby suppress aggregation of the fluorine resin fine particles in the protective layer to improve their dispersibility. Besides, the fluorine resin fine particles are fixed to a binder resin via the metal oxide fine particles, and thus the fluorine resin fine particles are less liable to be detached from the protective layer.

As described above, in order to reduce the change in image quality during a use period, it is important to reduce a wear amount of the electrophotographic photosensitive member.

According to an investigation made by the inventors, it has been found that in each of the electrophotographic photosensitive members described in Japanese Patent Application Laid-Open No. 2017-58524 and Japanese Patent Application Laid-Open No. 2017-125946, the incorporation of the inorganic fine particles results in a brittle film, and hence the wear resistance is insufficient or a deep flaw is generated through long-term use in some cases.

Therefore, an object of the present disclosure is to provide an electrophotographic photosensitive member having higher wear resistance and being less liable to have a deep flaw.

SUMMARY OF THE INVENTION

The above-mentioned object is achieved by the following present disclosure. That is, according to one aspect of the present disclosure, there is provided an electrophotographic photosensitive member including: a support; a charge-generating layer; and a charge-transporting layer, the charge-generating layer and the charge-transporting layer being arranged on the support, wherein a surface layer of the electrophotographic photosensitive member contains: inorganic particles ($\alpha$) having an average particle diameter ($L\alpha$) of primary particles of 5 nm or more and 50 nm or less; and resin particles ($\beta$) having an average particle diameter ($L\beta$) of primary particles of 0.1 μm or more and 5.0 μm or less, and wherein in any cross-section of the surface layer, the following expression (1) is satisfied, where a region within ($L\beta/2$) from a surface of each of the resin particles ($\beta$) is defined as a region (M), a sum of cross-sectional areas of the inorganic particles ($\alpha$) that are present in the cross-section is represented by ($S\alpha$), and a sum of cross-sectional areas of the inorganic particles ($\alpha$) that are included in the region (M) is represented by ($Sm\alpha$).

$$(Sm\alpha)/(S\alpha) \geq 0.3 \qquad \text{Expression (1)}$$

Further features of the present invention will become apparent from the following description of exemplary embodiments with reference to the attached drawings.

DESCRIPTION OF THE EMBODIMENTS

Figure 1:
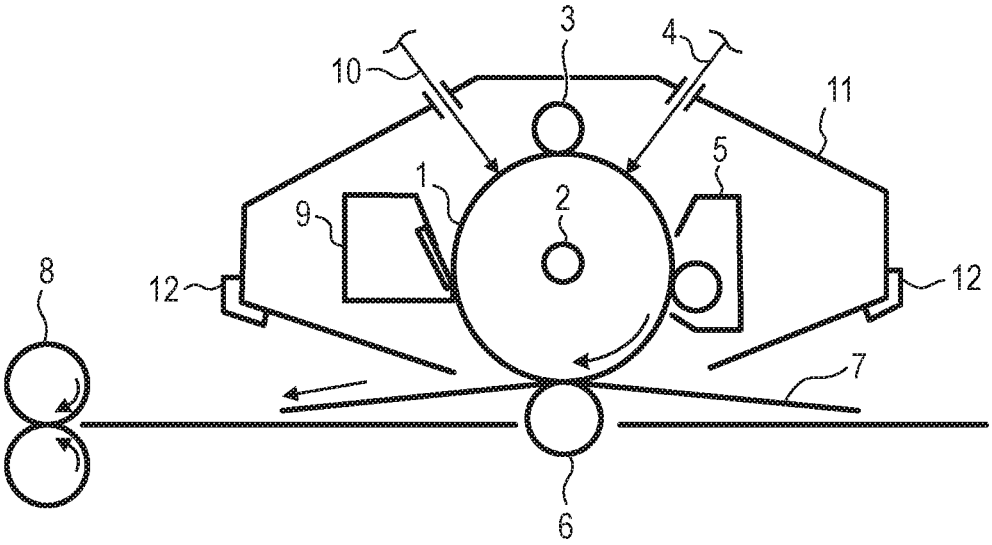
FIG. 1 is a view for illustrating an example of a schematic configuration of an electrophotographic image-forming apparatus including a process cartridge including an electrophotographic photosensitive member according to one aspect of the present disclosure.

The present disclosure is described in detail below by way of preferred embodiments.

An electrophotographic photosensitive member according to one aspect of the present disclosure includes: a support; a charge-generating layer; and a charge-transporting layer, the charge-generating layer and the charge-transporting layer being arranged on the support, wherein a surface layer of the electrophotographic photosensitive member contains: inorganic particles ($\alpha$) having an average particle diameter ($L\alpha$) of primary particles of 5 nm or more and 50 nm or less; and resin particles ($\beta$) having an average particle diameter ($L\beta$) of primary particles of 0.1 μm or more and 5.0 μm or less, and wherein in any cross-section of the surface layer, the following expression (1) is satisfied, where a region within ($L\beta/2$) from a surface of each of the resin particles ($\beta$) is defined as a region (M), a sum of cross-sectional areas of the inorganic particles ($\alpha$) that are present in the cross-section is represented by ($S\alpha$), and a sum of cross-sectional areas of the inorganic particles ($\alpha$) that are included in the region (M) is represented by ($Sm\alpha$).

$$(Sm\alpha)/(S\alpha) \geq 0.3 \qquad \text{Expression (1)}$$

According to an investigation made by the inventors, it has been found that in the configuration of Japanese Patent Application Laid-Open No. 2017-58524 or Japanese Patent Application Laid-Open No. 2017-125946, the surface layer contains inorganic particles, and hence becomes brittle as a film, though its hardness is increased. Consequently, depending on a use environment, wear resistance may not be remarkably exhibited or a deep flaw or the like may be generated.

In addition, it has been found that in the configuration of Japanese Patent Application Laid-Open No. 2017-125946, an increase in residual potential may be observed in some cases.

In order to solve the problems occurring in the related art described above, the inventors have made investigations with their attention focused on the arrangement of resin fine particles and inorganic particles in a film. As a result, it has been found that the wear of the surface layer and the occurrence of a deep flaw in the surface layer, which have occurred in the related art, can be reduced when: the surface layer contains inorganic particles (α) having an average particle diameter (Lα) of primary particles of 5 nm or more and 50 nm or less and resin particles (β) having an average particle diameter (Lβ) of primary particles of 0.1 μm or more and 5.0 μm or less; and in any cross-section of the surface layer, the expression (1) is satisfied, where a region within (Lβ/2) from a surface of each of the resin particles (β) is defined as a region (M), the sum of the cross-sectional areas of the inorganic particles (α) that are present in the any cross-section is represented by (Sα), and the sum of the cross-sectional areas of the inorganic particles (α) that are included in the region (M) is represented by (Smα).

$$(Sm\alpha)/(S\alpha) \geq 0.3 \qquad \text{Expression (1)}$$

A mechanism by which the configuration of one aspect of the present disclosure reduces the wear of the surface layer and the occurrence of a deep flaw in the surface layer, which are the problems of the related art, is presumed to be as described below.

A surface layer containing inorganic particles is decreased in elasticity to become brittle as a film, and hence the wear resistance is not sufficient in some cases or a deep flaw is generated in some cases. With a view to eliminating those problems, even when resin particles are incorporated into the surface layer of an electrophotographic photosensitive member together with the inorganic particles, the elasticity may be partially insufficient depending on their presence state in the surface layer, with the result that the occurrence of a deep flaw cannot be eliminated. According to the configuration of one aspect of the present disclosure, the inorganic particles are arranged in the vicinity of the resin particles, and hence the elasticity of the resin particles can be efficiently utilized. Accordingly, the decrease in elasticity due to the incorporation of the inorganic particles can be suppressed to reduce the brittleness of the film.

As described above, the effect of the present disclosure can be achieved through the interaction of the components with each other.

<Inorganic Particles (α)>

Examples of the inorganic particles (α) include silicon oxide (silica), magnesium oxide, zinc oxide, lead oxide, aluminum oxide (alumina), zirconium oxide, tin oxide, titanium oxide (titania), niobium oxide, molybdenum oxide, and vanadium oxide. Of those, from the viewpoints of a hardness, an insulating property, and light transmittance, silicon oxide (silica, $SiO_2$) and aluminum oxide (alumina, $Al_2O_3$) are preferred.

As the inorganic particles to be contained in the surface layer of the electrophotographic photosensitive member according to one aspect of the present disclosure, the inorganic particles having an average particle diameter (Lα) of primary particles of 5 nm or more and 50 nm or less are used from the viewpoint of suppressing the occurrence of a black spot and a white spot in an image printed using the electrophotographic photosensitive member or the cracking of the electrophotographic photosensitive member.

The inorganic particles each preferably have a surface treated with a silicone oil or at least one compound selected from compounds represented by the structural formula (1) and the structural formula (2) from the viewpoint of affinity with the resin particles:

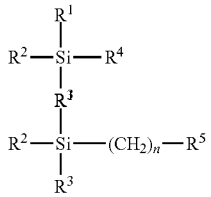

(1)

(2)

in the structural formulae (1) and (2), $R^1$ to $R^3$ each independently represent an alkoxy group or an alkyl group, provided that at least two of $R^1$ to $R^3$ each represent an alkoxy group, $R^4$ represents a vinyl group, a 1-methylvinyl group, an acryloyloxy group, or a methacryloyloxy group, $R^5$ represents an acryloyloxy group or a methacryloyloxy group, and "n" represents an integer of 1 or more and 6 or less.

Specific examples of the compounds represented by the structural formula (1) and the structural formula (2) include compounds represented by the following structural formulae (P-1) to (P-21).

$H_2C{=}CHSi(CH_3)(OCH_3)_2$ (P-1)

$H_2C{=}CHSi(OCH_3)_3$ (P-2)

$H_2C{=}CHCOO(CH_2)_2Si(CH_3)(OCH_3)_2$ (P-3)

$H_2C{=}CHCOO(CH_2)_2Si(OCH_3)_3$ (P-4)

$H_2C{=}CHCOO(CH_2)_3Si(CH_3)(OCH_3)_2$ (P-5)

$H_2C{=}CHCOO(CH_2)_3Si(OCH_3)_3$ (P-6)

$H_2C{=}C(CH_3)COO(CH_2)_2Si(CH_3)(OCH_3)_2$ (P-7)

$H_2C{=}C(CH_3)COO(CH_2)_2Si(OCH_3)_3$ (P-8)

$H_2C{=}C(CH_3)COO(CH_2)_3Si(CH_3)(OCH_3)_2$ (P-9)

$H_2C{=}C(CH_3)COO(CH_2)Si(OCH_3)_2$ (P-10)

$H_2C{=}CHSi(C_2H_5)(OCH_3)_2$ (P-11)

$H_2C{=}C(CH_3)Si(OCH_3)_3$ (P-12)

$H_2C{=}C(CH_3)Si(OC_2H_6)_3$ (P-13)

$H_2C{=}CHSi(OCH_3)_3$ (P-14)

$H_2C{=}C(CH_3)Si(CH_3)(OCH_3)_2$ (P-15)

$H_2C{=}CHCOOSi(OCH_3)_3$ (P-16)

$H_2C{=}CHCOOSi(OC_2H_6)$ (P-17)

$H_2C{=}CHCOOSi(OC_2H_5)_3$ (P-18)

$H_2C{=}C(CH_3)COOSi(OC_2H_5)_3$ (P-19)

$H_2C{=}C(CH_3)COOSi(OC_2H_5)_3$ (P-20)

$H_2C{=}C(CH_3)COO(CH_2)_3Si(OC_2H_5)_3$ (P-21)

<Resin Particles (β)>

As the resin particles contained in the surface layer of the electrophotographic photosensitive member according to one aspect of the present disclosure, particles of a polymethyl methacrylate resin (PMMA), a melamine resin of a melamine-formaldehyde polycondensation type, a melamine-benzoguanamine-formaldehyde copolycondensation type, or the like, a benzoguanamine resin, a styrene acrylic resin, a silicone resin, a fluorine resin, or the like may be used. Of those, particles of a resin selected from PMMA, a melamine resin of a melamine-formaldehyde polycondensation type, and a fluorine resin are preferably used.

The average particle diameter (Lβ) of primary particles of the resin particles is determined from a cross-section of the surface layer of the electrophotographic photosensitive member. Specifically, 50 resin particles in the cross-section of the surface layer are observed to acquire an image. The image is subjected to ellipse fitting to determine longest diameters. The average of the 10 largest longest diameters of the 50 determined longest diameters is defined as the average particle diameter (Lβ) of primary particles of the resin particles. The average particle diameter (Lβ) is 0.1 μm or more and 5.0 μm or less, and is more preferably 0.1 μm or more and 1.5 μm or less from the viewpoint of suppressing a black spot and a white spot.

<Region (M)>

Figure 2A:
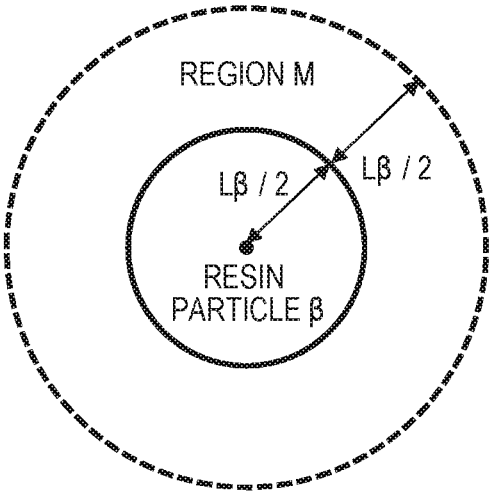
FIG. 2A is a view for illustrating a relationship between a region (M) and an average particle diameter ($L\beta$) of primary particles of resin particles ($\beta$).

As illustrated in FIG. 2A, the region (M) is a region present within a distance of (Lβ/2) from the outermost surface of each of the resin particles.

When (Sα), which represents the sum of the cross-sectional areas of the inorganic particles (α) that are present in any cross-section of the surface layer, and (Smα), which represents the sum of the cross-sectional areas of the inorganic particles (α) that are included in the region (M) in the cross-section, satisfy the expression (1), that is, the inorganic particles are present near the resin particles, the elasticity of the resin particles can be effectively utilized. Thus, the effect of the present disclosure can be obtained. Further, when the following expression (2) is satisfied, that is, many inorganic particles are present near the resin particles, the surface layer more easily obtains the elasticity of the resin particles, and hence a further effect can be obtained from the viewpoint of the wear resistance of the film.

$$(Sm\alpha)/(S\alpha) \geq 0.5 \qquad \text{Expression (2)}$$

<Region (M')>

Figure 2B:
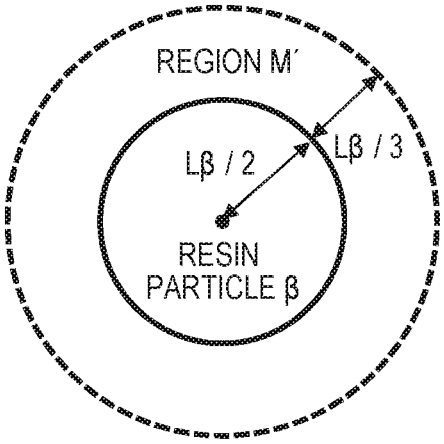
FIG. 2B is a view for illustrating a relationship between a region (M') and the average particle diameter ($L\beta$) of primary particles of the resin particles ($\beta$).

As illustrated in FIG. 2B, the region (M') is a region present within a distance of (Lβ/3) from the outermost surface of each of the resin particles in any cross-section of the surface layer.

When a relationship between the total area (Sα) of the inorganic particles that are present in any cross-section of the surface layer and the area (Sm'α) of the inorganic particles that are present in the region (M') satisfies the following expression (3), the surface layer can more effectively utilize the elasticity of the resin particles. That is, when many inorganic particles are present nearer to the resin particles, a further effect can be obtained from the viewpoint of the wear resistance of the film.

$$(Sm'\alpha)/(S\alpha) \geq 0.3 \qquad \text{Expression (3)}$$

<Measurement Method for Sα, Smα, and Sm'α>

A measurement method for Sα is performed, for example, as described below.

The photosensitive member is cut at any position to cut out a piece measuring 10 mm square, and the resultant cross-section is processed into a smooth cross-section. Magnified observation is performed from a cross-sectional direction, and the observed image is captured. The sum of areas occupied by the inorganic fine particles that are included in the cross-section is calculated based on the captured image, to thereby calculate Sα. Smα and Sm'α are determined in the ranges of the region (M) and the region (M') in the same manner as in the calculation method for Sα.

In order to perform accurate calculation of Sα, Smα, and Sm'α, the cross-section is preferably prepared with ion beams or the like, and the cross-section is preferably observed with a scanning electron microscope or the like.

In addition, in the calculation of Sα, Smα, and Sm'α, image processing, such as binarization, may be used after the identification of the inorganic fine particles by elemental analysis.

A method of producing the photosensitive member according to one aspect of the present disclosure is not limited as long as the features of the present disclosure are satisfied. However, as a method of more efficiently obtaining the photosensitive member, it is preferred to use composite particles of the inorganic particles and the resin particles.

[Electrophotographic Photosensitive Member]

The electrophotographic photosensitive member according to one aspect of the present disclosure includes a charge-generating layer, a charge-transporting layer, and a surface layer in the stated order on a support.

A method of producing the electrophotographic photosensitive member according to one aspect of the present disclosure is, for example, a method involving: preparing coating liquids for the respective layers to be described later; applying the liquids in a desired order of the layers; and drying the liquids. In this case, examples of the method of applying the coating liquid include dip coating, spray coating, inkjet coating, roll coating, die coating, blade coating, curtain coating, wire bar coating, and ring coating. Of those, dip coating is preferred from the viewpoints of efficiency and productivity.

Now, the respective layers are described.

<Support>

In one aspect of the present disclosure, the electrophotographic photosensitive member includes the support. In one aspect of the present disclosure, the support is preferably a conductive support having conductivity. In addition, examples of the shape of the support include a cylindrical shape, a belt shape, and a sheet shape. Of those, a cylindrical support is preferred. In addition, the surface of the support may be subjected to, for example, an electrochemical treatment, such as anodization, a blast treatment, or a cutting treatment.

A metal, a resin, glass, or the like is preferred as a material for the support.

Examples of the metal include aluminum, iron, nickel, copper, gold, stainless steel, and alloys thereof. Of those, an aluminum support using aluminum is preferred.

In addition, conductivity may be imparted to the resin or the glass through a treatment involving, for example, mixing or coating the resin or the glass with a conductive material.

<Conductive Layer>

In one aspect of the present disclosure, the conductive layer may be arranged on the support. The arrangement of the conductive layer can conceal flaws and irregularities in the surface of the support, and control the reflection of light on the surface of the support.

The conductive layer preferably contains conductive particles and a resin.

A material for the conductive particles is, for example, a metal oxide, a metal, or carbon black. Examples of the metal oxide include zinc oxide, aluminum oxide, indium oxide, silicon oxide, zirconium oxide, tin oxide, titanium oxide, magnesium oxide, antimony oxide, and bismuth oxide. Examples of the metal include aluminum, nickel, iron, nichrome, copper, zinc, and silver.

Of those, a metal oxide is preferably used as the conductive particles, and in particular, titanium oxide, tin oxide, and zinc oxide are more preferably used.

When the metal oxide is used as the conductive particles, the surface of the metal oxide may be treated with a silane coupling agent or the like, or the metal oxide may be doped with an element, such as phosphorus or aluminum, or an oxide thereof.

In addition, each of the conductive particles may be of a laminated construction having a core particle and a coating layer coating the particle. Examples of the core particle include titanium oxide, barium sulfate, and zinc oxide. The coating layer is, for example, a metal oxide, such as tin oxide.

In addition, when the metal oxide is used as the conductive particles, their volume-average particle diameter is preferably 1 nm or more and 500 nm or less, more preferably 3 nm or more and 400 nm or less.

Examples of the resin include a polyester resin, a polycarbonate resin, a polyvinyl acetal resin, an acrylic resin, a silicone resin, an epoxy resin, a melamine resin, a polyurethane resin, a phenol resin, and an alkyd resin.

In addition, the conductive layer may further contain a concealing agent, such as a silicone oil, resin particles, or titanium oxide.

The conductive layer has an average thickness of preferably 1 μm or more and 50 μm or less, particularly preferably 3 μm or more and 40 μm or less.

The conductive layer may be formed by preparing a coating liquid for a conductive layer containing the above-mentioned materials and a solvent, forming a coat thereof, and drying the coat. Examples of the solvent to be used for the coating liquid include an alcohol-based solvent, a sulfoxide-based solvent, a ketone-based solvent, an ether-based solvent, an ester-based solvent, and an aromatic hydrocarbon-based solvent. As a dispersion method for dispersing the conductive particles in the coating liquid for a conductive layer, there are given methods using a paint shaker, a sand mill, a ball mill, and a liquid collision-type high-speed disperser.

<Undercoat Layer>

In one aspect of the present disclosure, the undercoat layer may be arranged on the support or the conductive layer. The arrangement of the undercoat layer can improve an adhesive function between layers to impart a charge injection-inhibiting function.

The undercoat layer preferably contains a resin. In addition, the undercoat layer may be formed as a cured film by polymerizing a composition containing a monomer having a polymerizable functional group.

Examples of the resin include a polyester resin, a polycarbonate resin, a polyvinyl acetal resin, an acrylic resin, an epoxy resin, a melamine resin, a polyurethane resin, a phenol resin, a polyvinyl phenol resin, an alkyd resin, a polyvinyl alcohol resin, a polyethylene oxide resin, a polypropylene oxide resin, a polyamide resin, a polyamide acid resin, a polyimide resin, a polyamide imide resin, and a cellulose resin.

Examples of the polymerizable functional group of the monomer having a polymerizable functional group include an isocyanate group, a blocked isocyanate group, a methylol group, an alkylated methylol group, an epoxy group, a metal alkoxide group, a hydroxyl group, an amino group, a carboxyl group, a thiol group, a carboxylic acid anhydride group, and a carbon-carbon double bond group.

In addition, the undercoat layer may further contain an electron-transporting substance, a metal oxide, a metal, a conductive polymer, and the like for the purpose of improving electric characteristics. Of those, an electron-transporting substance and a metal oxide are preferably used.

Examples of the electron-transporting substance include a quinone compound, an imide compound, a benzimidazole compound, a cyclopentadienylidene compound, a fluorenone compound, a xanthone compound, a benzophenone compound, a cyanovinyl compound, a halogenated aryl compound, a silole compound, and a boron-containing compound. An electron-transporting substance having a polymerizable functional group may be used as the electron-transporting substance and copolymerized with the above-mentioned monomer having a polymerizable functional group to form the undercoat layer as a cured film.

Examples of the metal oxide particles include indium tin oxide, tin oxide, indium oxide, titanium oxide, zinc oxide, aluminum oxide, and silicon dioxide. Examples of the metal include gold, silver, and aluminum.

In addition, the undercoat layer may further contain an additive.

The average thickness of the undercoat layer is preferably 0.1 μm or more and 50 μm or less, more preferably 0.2 μm or more and 40 μm or less, particularly preferably 0.3 μm or more and 30 μm or less.

The undercoat layer may be formed by preparing a coating liquid for an undercoat layer containing the above-mentioned materials and a solvent, forming a coat thereof, and drying and/or curing the coat. Examples of the solvent to be used for the coating liquid include an alcohol-based solvent, a ketone-based solvent, an ether-based solvent, an ester-based solvent, and an aromatic hydrocarbon-based solvent.

<Photosensitive Layer>

The photosensitive layers of electrophotographic photosensitive members are mainly classified into (1) a laminated photosensitive layer and (2) a single-layer photosensitive layer. (1) The laminated photosensitive layer has a charge-generating layer containing a charge-generating substance and a charge-transporting layer containing a charge-transporting substance. (2) The single-layer photosensitive layer has a photosensitive layer containing both a charge-generating substance and a charge-transporting substance.

When the electrophotographic photosensitive member does not include a protective layer to be described later, in (1) the laminated photosensitive layer, the charge-transporting layer is the surface layer in one aspect of the present disclosure, and in (2) the single-layer photosensitive layer, the photosensitive layer is the surface layer in one aspect of the present disclosure.

(1) Laminated Photosensitive Layer

The laminated photosensitive layer is a laminated photosensitive layer including the charge-generating layer and the charge-transporting layer.

(1) Charge-Generating Layer

The charge-generating layer preferably contains the charge-generating substance and a resin.

Examples of the charge-generating substance include azo pigments, perylene pigments, polycyclic quinone pigments, indigo pigments, and phthalocyanine pigments. Of those, azo pigments and phthalocyanine pigments are preferred. Of the phthalocyanine pigments, an oxytitanium phthalocyanine pigment, a chlorogallium phthalocyanine pigment, and a hydroxygallium phthalocyanine pigment are preferred.

The content of the charge-generating substance in the charge-generating layer is preferably 40 mass % or more and 85 mass % or less, more preferably 60 mass % or more and 80 mass % or less with respect to the total mass of the charge-generating layer.

Examples of the resin include a polyester resin, a polycarbonate resin, a polyvinyl acetal resin, a polyvinyl butyral resin, an acrylic resin, a silicone resin, an epoxy resin, a melamine resin, a polyurethane resin, a phenol resin, a polyvinyl alcohol resin, a cellulose resin, a polystyrene resin, a polyvinyl acetate resin, and a polyvinyl chloride resin. Of those, a polyvinyl butyral resin is more preferred.

In addition, the charge-generating layer may further contain an additive, such as an antioxidant or a UV absorber. Specific examples thereof include a hindered phenol compound, a hindered amine compound, a sulfur compound, a phosphorus compound, and a benzophenone compound.

The charge-generating layer has an average thickness of preferably 0.1 μm or more and 1 μm or less, more preferably 0.15 μm or more and 0.4 μm or less.

The charge-generating layer may be formed by preparing a coating liquid for a charge-generating layer containing the above-mentioned materials and a solvent, forming a coat thereof, and drying the coat. Examples of the solvent to be used for the coating liquid include an alcohol-based solvent, a sulfoxide-based solvent, a ketone-based solvent, an ether-based solvent, an ester-based solvent, and an aromatic hydrocarbon-based solvent.

(2) Charge-Transporting Layer

The charge-transporting layer preferably contains the charge-transporting substance and a resin.

Examples of the charge-transporting substance include a polycyclic aromatic compound, a heterocyclic compound, a hydrazone compound, a styryl compound, an enamine compound, a benzidine compound, a triarylamine compound, and a resin having a group derived from each of those substances. Of those, a triarylamine compound and a benzidine compound are preferred.

The content of the charge-transporting substance in the charge-transporting layer is preferably 25 mass % or more and 70 mass % or less, more preferably 30 mass % or more and 55 mass % or less with respect to the total mass of the charge-transporting layer.

Examples of the resin include a polyester resin, a polycarbonate resin, an acrylic resin, and a polystyrene resin. Of those, a polycarbonate resin and a polyester resin are preferred. A polyarylate resin is particularly preferred as the polyester resin.

A content ratio (mass ratio) between the charge-transporting substance and the resin is preferably from 4:10 to 20:10, more preferably from 5:10 to 12:10.

In addition, the charge-transporting layer may contain an additive, such as an antioxidant, a UV absorber, a plasticizer, a leveling agent, a lubricity-imparting agent, or a wear resistance-improving agent. Specific examples thereof include a hindered phenol compound, a hindered amine compound, a sulfur compound, a phosphorus compound, a benzophenone compound, a siloxane-modified resin, a silicone oil, fluorine resin particles, polystyrene resin particles, polyethylene resin particles, silica particles, alumina particles, and boron nitride particles.

The charge-transporting layer has an average thickness of 5 μm or more and 50 μm or less, more preferably 8 μm or more and 40 μm or less, particularly preferably 10 μm or more and 30 μm or less.

The charge-transporting layer may be formed by preparing a coating liquid for a charge-transporting layer containing the above-mentioned materials and a solvent, forming a coat thereof, and drying the coat. When the charge-transporting layer is the surface layer in one aspect of the present disclosure, the coating liquid for a charge-transporting layer further contains the inorganic particles (α) and the resin particles (β). Examples of the solvent to be used for the coating liquid include an alcohol-based solvent, a ketone-based solvent, an ether-based solvent, an ester-based solvent, and an aromatic hydrocarbon-based solvent. Of those solvents, an ether-based solvent or an aromatic hydrocarbon-based solvent is preferred.

(2) Single-Layer Photosensitive Layer

The single-layer photosensitive layer may be formed by preparing a coating liquid for a photosensitive layer containing the charge-generating substance, the charge-transporting substance, a binder resin, and a solvent, forming a coat thereof, and drying the coat. Examples of the charge-generating substance, the charge-transporting substance, and the binder resin are the same as those of the materials in the section "(1) Laminated Photosensitive Layer."

When the single-layer photosensitive layer is the surface layer in one aspect of the present disclosure, the single-layer photosensitive layer contains the inorganic particles (α) and the resin particles (β).

<Protective Layer>

In the electrophotographic photosensitive member according to one aspect of the present disclosure, a protective layer may be arranged as the surface layer on the photosensitive layer. The arrangement of the protective layer can improve durability.

The surface layer preferably contains the inorganic particles and the resin particles, a charge-transporting substance, and a resin.

Examples of the charge-transporting substance include a polycyclic aromatic compound, a heterocyclic compound, a hydrazone compound, a styryl compound, an enamine compound, a benzidine compound, a triarylamine compound, and a resin having a group derived from each of those substances. Of those, a triarylamine compound and a benzidine compound are preferred.

Examples of the resin include a polyester resin, an acrylic resin, a phenoxy resin, a polycarbonate resin, a polystyrene resin, a phenol resin, a melamine resin, and an epoxy resin. Of those, a polycarbonate resin, a polyester resin, and an acrylic resin are preferred.

In addition, the protective layer may be formed as a cured film by polymerizing a composition containing a monomer having a polymerizable functional group. As a reaction in this case, there are given, for example, a thermal polymerization reaction, a photopolymerization reaction, and a radiation polymerization reaction. Examples of the polymerizable functional group of the monomer having a polymerizable functional group include an acryl group and a methacryl group. A material having a charge-transporting ability may be used as the monomer having a polymerizable functional group.

The protective layer may further contain an additive, such as an antioxidant, a UV absorber, a plasticizer, a leveling agent, or a lubricity-imparting agent, in addition to the inorganic particles and the resin particles according to one aspect of the present disclosure. Specific examples thereof include a hindered phenol compound, a hindered amine compound, a sulfur compound, a phosphorus compound, a benzophenone compound, a siloxane-modified resin, and a silicone oil.

The protective layer has an average thickness of preferably 0.5 μm or more and 10 μm or less, more preferably 1 μm or more and 7 μm or less.

The protective layer may be formed by preparing a coating liquid for a protective layer containing the above-mentioned materials and a solvent, forming a coat thereof, and drying and/or curing the coat. Examples of the solvent to be used for the coating liquid include an alcohol-based solvent, a ketone-based solvent, an ether-based solvent, a sulfoxide-based solvent, an ester-based solvent, and an aromatic hydrocarbon-based solvent.

[Process Cartridge and Electrophotographic Apparatus]

A process cartridge according to one aspect of the present disclosure integrally supports the electrophotographic photosensitive member described in the foregoing, and at least one unit selected from the group consisting of a charging unit, a developing unit, a transferring unit, and a cleaning unit, and is removably mounted onto the main body of an electrophotographic apparatus.

In addition, an electrophotographic apparatus according to one aspect of the present disclosure includes the electrophotographic photosensitive member described in the foregoing, and at least one unit selected from the group consisting of a charging unit, an exposing unit, a developing unit, and a transferring unit.

An example of the schematic construction of an electrophotographic apparatus including a process cartridge including an electrophotographic photosensitive member is illustrated in FIG. 1.

A cylindrical electrophotographic photosensitive member 1 is rotationally driven about a shaft 2 in a direction indicated by the arrow at a predetermined peripheral speed. The surface of the electrophotographic photosensitive member 1 is charged to a predetermined positive or negative potential by a charging unit 3. In FIG. 1, a roller charging system based on a roller-type charging member is illustrated, but a charging system such as a corona charging system, a proximity charging system, or an injection charging system may be adopted. The charged surface of the electrophotographic photosensitive member 1 is irradiated with exposure light 4 from an exposing unit (not shown), and hence an electrostatic latent image corresponding to target image information is formed thereon. The electrostatic latent image formed on the surface of the electrophotographic photosensitive member 1 is developed with a toner stored in a developing unit 5, and a toner image is formed on the surface of the electrophotographic photosensitive member 1. The toner image formed on the surface of the electrophotographic photosensitive member 1 is transferred onto a transfer material 7 by a transferring unit 6. The transfer material 7 onto which the toner image has been transferred is conveyed to a fixing unit 8, is subjected to a treatment for fixing the toner image, and is printed out to the outside of the electrophotographic apparatus. The electrophotographic apparatus may include a cleaning unit 9 for removing a deposit, such as the toner remaining on the surface of the electrophotographic photosensitive member 1 after the transfer. In addition, a so-called cleaner-less system configured to remove the deposit with the developing unit or the like without separate arrangement of the cleaning unit may be used. The electrophotographic apparatus may include an electricity-removing mechanism configured to subject the surface of the electrophotographic photosensitive member 1 to an electricity-removing treatment with pre-exposure light 10 from a pre-exposing unit (not shown). In addition, a guiding unit 12, such as a rail, may be arranged for removably mounting a process cartridge according to one aspect of the present disclosure onto the main body of an electrophotographic apparatus.

The electrophotographic photosensitive member according to one aspect of the present disclosure can be used in, for example, a laser beam printer, an LED printer, a copying machine, a facsimile, and a multifunctional peripheral thereof.

EXAMPLES

The present disclosure is described in more detail below by way of Examples and Comparative Examples. The present disclosure is by no means limited to the following Examples, and various modifications may be made without departing from the gist of the present disclosure. In the description in the following Examples, "part(s)" is by mass unless otherwise specified.

Production Example of Particles S1

100 Parts by mass of untreated silica having an average particle diameter of 40 nm was placed in a 2 L autoclave with a stirrer, and heated to 200° C. while being fluidized by stirring. While the fluidized state was maintained, the inside of the autoclave was purged with a nitrogen gas and the reaction vessel was hermetically sealed. While the silica was stirred, a dimethyl silicone oil (viscosity=50 $mm^2/s$) was sprayed as a surface treatment agent with its amount adjusted to be 20 parts by mass after treatment, and stirring was continued for 30 minutes. After that, the resultant was increased in temperature to 300° C. under stirring, and further stirred for 2 hours. The silica was removed from the autoclave. Thus, S1 was obtained.

Production Example of Particles S2

Particles were produced in the same manner as in the production example of the particles S1 except that the amounts of the silica and the silicone oil were changed as shown in Table 1. The resultant particles were named "S2". Details are shown in Table 1.

Production Example of Particles S3

100 Parts of silica (average primary particle diameter: 40 nm) was mixed with 500 parts of toluene under stirring, and 0.8 part of octyltriethoxysilane (product name: KBE3083, manufactured by Shin-Etsu Chemical Co., Ltd.) was added as a surface treatment agent, followed by stirring for 6 hours.

After that, toluene was removed by distillation under reduced pressure, and the residue was dried by heating at 140° C. for 6 hours to provide surface-treated silica S3.

Production Examples of Particles S4 and Particles S5

Particles were produced in the same manner as in the production example of the particles S3 except that the amounts of the silica and the surface treatment agent were changed as shown in Table 1. The resultant particles were named "Particles S4 and Particles S5." Details are shown in Table 1.

Production Example of Particles A1

100 Parts of aluminum oxide particles (average primary particle diameter: 10 nm, specific surface area: 150 $m^2/g$)

were mixed with 500 parts of toluene under stirring, and 1.03 parts of a silicone oil (product name: KBE3083, manufactured by Shin-Etsu Chemical Co., Ltd.) was added as a surface treatment agent, followed by stirring for 6 hours.

After that, toluene was removed by distillation under reduced pressure, and the residue was dried by heating at 140° C. for 6 hours to provide surface-treated aluminum oxide particles A1.

Production Example of Particles A2

100 Parts of aluminum oxide particles (average primary particle diameter: 18 nm, specific surface area: 65 $m^2/g$) were mixed with 500 parts of toluene under stirring, and 1.03 parts of octyltriethoxysilane (product name: KBE3083, manufactured by Shin-Etsu Chemical Co., Ltd.) was added as a surface treatment agent, followed by stirring for 6 hours. After that, toluene was removed by distillation under reduced pressure, and the residue was dried by heating at 140° C. for 6 hours to provide surface-treated aluminum oxide particles A2.

Production Example of Particles A3

100 Parts of aluminum oxide particles (average primary particle diameter: 18 nm, specific surface area: 65 $m^2/g$) were mixed with 500 parts of toluene under stirring, and 1.1 parts of octyltriethoxysilane (product name: KBE3083, manufactured by Shin-Etsu Chemical Co., Ltd.) was added as a surface treatment agent, followed by stirring for 6 hours.

After that, toluene was removed by distillation under reduced pressure, and the residue was dried by heating at 140° C. for 6 hours to provide surface-treated aluminum oxide particles A3.

Production Example of Particles A4

100 Parts of aluminum oxide particles (average primary particle diameter: 18 nm, specific surface area: 65 $m^2/g$) were mixed with 500 parts of toluene under stirring, and 1.03 parts of the compound P-10 (product name: KBE3083, manufactured by Shin-Etsu Chemical Co., Ltd.) was added as a surface treatment agent, followed by stirring for 6 hours.

After that, toluene was removed by distillation under reduced pressure, and the residue was dried by heating at 140° C. for 6 hours to provide surface-treated aluminum oxide particles A4.

TABLE 1

| Inorganic particles | | | | Surface treatment agent | |
|---|---|---|---|---|---|
| Name | Kind | Average particle diameter [nm] | Part(s) by mass | Kind | Part(s) by mass |
| S1 | Silica | 40 | 100 | Silicone oil | 20 |
| S2 | Silica | 9 | 100 | Silicone oil | 30 |
| S3 | Silica | 40 | 100 | Octyltriethoxysilane | 1.0 |

TABLE 1-continued

| Inorganic particles | | | | Surface treatment agent | |
|---|---|---|---|---|---|
| Name | Kind | Average particle diameter [nm] | Part(s) by mass | Kind | Part(s) by mass |
| S4 | Silica | 9 | 100 | Octyltriethoxysilane | 1.1 |
| S5 | Silica | 40 | 100 | Compound P-10 | 1.03 |
| A1 | Aluminum oxide | 10 | 100 | Silicone oil | 1.0 |
| A2 | Aluminum oxide | 18 | 100 | Silicone oil | 0.8 |
| A3 | Aluminum oxide | 18 | 100 | Octyltriethoxysilane | 1.1 |
| A4 | Aluminum oxide | 18 | 100 | Compound P-10 | 1.03 |

Production Example of Composite Particles $H_1$

200 Parts of the particles S1 and 100 parts of melamine-formaldehyde condensate particles having an average particle diameter of 0.4 μm (product name: EPOSTAR S6, manufactured by Nippon Shokubai Co., Ltd.) were mixed and stirred in a coffee mill for 10 seconds, which was repeated 10 times to provide composite particles H1.

Production Examples of Composite Particles H2 to Composite Particles H24

Composite particles were all obtained in the same manner as in the production example of the composite particles H1 except that inorganic particles and resin particles shown in Table 2 were respectively used and the conditions were changed as shown in Table 2. The resultant composite particles are referred to as "composite particles H2 to composite particles H24."

The resin particles (β) used in the production of the composite particles H2 to the composite particles H24 are as follows.

Melamine-formaldehyde condensate (S6) (product name: EPOSTAR (trademark) S6, manufactured by Nippon Shokubai Co., Ltd.)

Melamine-formaldehyde condensate (S12) (product name: EPOSTAR (trademark) S12, manufactured by Nippon Shokubai Co., Ltd.)

Melamine-formaldehyde condensate (SS) (product name: EPOSTAR (trademark) SS, manufactured by Nippon Shokubai Co., Ltd.)

PMMA (MA1002) (product name: EPOSTAR (trademark) MA1002, manufactured by Nippon Shokubai Co., Ltd.)

PMMA (MA1004) (product name: EPOSTAR (trademark) MA1004, manufactured by Nippon Shokubai Co., Ltd.)

TABLE 2

| Composite particles | Inorganic particles Kind | Inorganic particles Parts | Resin particles (β) Kind | Resin particles (β) Average particle diameter [μm] | Resin particles (β) Parts | Total treatment time [s] |
|---|---|---|---|---|---|---|
| 1 | S1 | 45 | Melamine-formaldehyde condensate (S6) | 0.38 | 100 | 100 |
| 2 | S1 | 200 | Melamine-formaldehyde condensate (SS) | 0.14 | 100 | 100 |
| 3 | S1 | 15 | Melamine-formaldehyde condensate (S12) | 1.04 | 100 | 100 |
| 4 | S1 | 12 | PMMA (MA1002) | 2.2 | 100 | 100 |
| 5 | S1 | 6 | PMMA (MA1004) | 3.5 | 100 | 100 |
| 6 | S2 | 43 | Melamine-formaldehyde condensate (SS) | 0.14 | 100 | 100 |
| 7 | S2 | 3.5 | Melamine-formaldehyde condensate (S12) | 1.24 | 100 | 100 |
| 8 | S2 | 2.5 | PMMA (MA1002) | 2.2 | 100 | 100 |
| 9 | S2 | 1.2 | PMMA (MA1004) | 3.5 | 100 | 100 |
| 10 | S3 | 200 | Melamine-formaldehyde condensate (SS) | 0.14 | 100 | 100 |
| 11 | S3 | 6 | PMMA (MA1004) | 3.5 | 100 | 100 |
| 12 | S4 | 43 | Melamine-formaldehyde condensate (SS) | 0.14 | 100 | 100 |
| 13 | S4 | 1.2 | PMMA (MA1004) | 3.5 | 100 | 100 |
| 14 | S1 | 15 | Melamine-formaldehyde condensate (S12) | 1.2 | 100 | 70 |
| 15 | S2 | 6 | Fluorine resin fine particles | 0.21 | 100 | 100 |
| 16 | S1 | 12 | PMMA (MA1002) | 2.2 | 100 | 30 |
| 17 | Al | 7 | Melamine-formaldehyde condensate (S12) | 1.24 | 100 | 100 |
| 18 | A2 | 150 | Melamine-formaldehyde condensate (SS) | 0.14 | 100 | 100 |
| 19 | A3 | 13 | Melamine-formaldehyde condensate (S12) | 1.04 | 100 | 100 |
| 20 | A4 | 13 | Melamine-formaldehyde condensate (S12) | 1.04 | 100 | 100 |
| 21 | S5 | 15 | Melamine-formaldehyde condensate (S12) | 1.04 | 100 | 100 |
| 22 | S2 | 10 | Melamine-formaldehyde condensate (S6) | 0.38 | 100 | 100 |
| 23 | S1 | 45 | Melamine-formaldehyde condensate (S6) | 0.38 | 100 | 40 |
| 24 | S1 | 200 | Melamine-formaldehyde condensate (SS) | 0.14 | 100 | 40 |

Production Example of Coating Liquid 1 for Protective Layer

70 Parts of a hole-transportable compound represented by the following structural formula (3), 5 parts of the particles H1, 30 parts of 1,1,2,2,3,3,4-heptafluorocyclopentane, and 30 parts of 1-propanol were mixed to provide a coating liquid 1 for a protective layer.

(3)

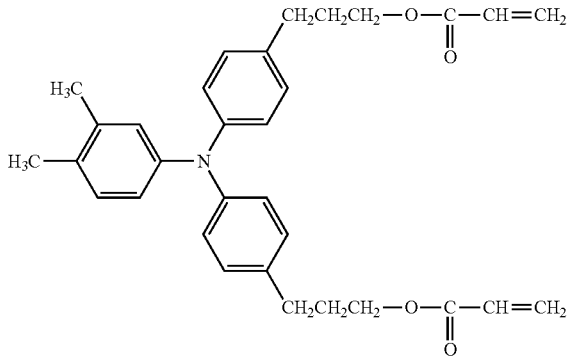

Production Examples of Coating Liquid 2 for Protective Layer to Coating Liquid 24 for Protective Layer Coating liquids 2 to 24 for protective layers were all obtained in the same manner as in the production example of the coating liquid 1 for a protective layer except that particles shown in Table 3 were used and the conditions were changed as shown in Table 3.

Production Example of Coating Liquid 101 for Protective Layer

70 Parts of the hole-transportable compound represented by the structural formula (3), 10.5 parts of the particles S1, 21 parts of melamine-formaldehyde condensate particles having an average particle diameter of 0.4 μm (product name: EPOSTAR S6, manufactured by Nippon Shokubai Co., Ltd.), 30 parts of 1,1,2,2,3,3,4-heptafluorocyclopentane, and 30 parts of 1-propanol were mixed to provide a coating liquid 101 for a protective layer.

Production Example of Coating Liquid 102 for Protective Layer

70 Parts of the hole-transportable compound represented by the structural formula (3), 1.6 parts of the particles S1, 3.5 parts of melamine-formaldehyde condensate particles having an average particle diameter of 0.4 μm (product name: EPOSTAR S6, manufactured by Nippon Shokubai Co., Ltd.), 30 parts of 1,1,2,2,3,3,4-heptafluorocyclopentane, and 30 parts of 1-propanol were mixed to provide a coating liquid 102 for a protective layer.

Production Example of Coating Liquid 103 for Protective Layer

Antimony-doped tin oxide (hereinafter referred to as ATO) fine particles (product name: T-1, manufactured by Mitsubishi Materials Electronic Chemicals Co., Ltd., average particle diameter: 10 nm to 15 nm) were used as raw material inorganic particles.

The following materials were prepared in such amounts that their mixing ratios with respect to the ATO fine particles had values shown below.

1H,1H,2H,2H-Nonafluorohexyltrimethoxysilane serving as a fluorine-based silane coupling agent (product name: T2918, manufactured by Tokyo Chemical Industry Co., Ltd.)

10 mass %

Octenyltrimethoxysilane serving as a polymerizable silane coupling agent (product name: KBM1083, manufactured by Shin-Etsu Chemical Co., Ltd.)

4 mass %

Isopropyl alcohol (IPA) serving as a dispersion solvent (manufactured by Kishida Chemical Co., Ltd., special grade reagent 99.5%)

200 mass %

Those materials were mixed and dispersed using a bead mill to prepare an ATO fine particle dispersion liquid. The dispersion time was set to 90 hours.

Subsequently, the following materials were prepared.

2-Methyl-1-(4-methylthiophenyl)-2-morpholinopropan-1-one serving as a polymerization initiator (product name: Irgacure 907, manufactured by BASF Japan)

10 parts by mass

Polyfunctional fluorine-modified acrylic resin serving as a photocurable resin (product name: ACU-3, manufactured by Kanto Denka Kogyo Co., Ltd.)

100 parts by mass

Isopropyl alcohol (IPA) serving as a dispersion solvent (manufactured by Kishida Chemical Co., Ltd., special grade reagent 99.5%)

150 parts by mass

Polytetrafluoroethylene (PTFE) fine particles serving as fluorine resin fine particles (product name: KTL1N, manufactured by Kitamura Limited, average particle diameter: 2.3 μm, maximum particle diameter: 4.62 μm)

30 parts by mass

Those materials were mixed and added to 100 parts by mass of the above-mentioned ATO fine particle dispersion liquid. After that, under a light-shielding condition, the materials were mixed and stirred, and while the mixed liquid was irradiated with an ultrasonic wave oscillated from an ultrasonic wave oscillator (oscillatory frequency: 40 kHz, ultrasonic output: 50 W) for 5 minutes, the components in the mixed liquid were dispersed in the dispersion solvent to prepare a coating liquid 103 for a protective layer.

<Production of Electrophotographic Photosensitive Member>

Production Example of Electrophotographic Photosensitive Member

Production Example of Photosensitive Member 1

An aluminum cylinder having a diameter of 30 mm and a length of 357.5 mm was used as a support (cylindrical support).

Next, 60 parts of tin oxide-coated barium sulfate particles (product name: Passtran PC1, manufactured by Mitsui Mining & Smelting Co., Ltd.), 15 parts of titanium oxide particles (product name: TITANIX JR, manufactured by Tayca Corporation), 43 parts of a resol-type phenolic resin (product name: PHENOLITE J-325, manufactured by Dainippon Ink and Chemicals, Incorporated, solid content: 70 mass %), 0.015 part of a silicone oil (product name: SH28PA, manufactured by Toray Silicone Co., Ltd.), 3.6 parts of silicone resin particles (product name: Tospearl 120, manufactured by Toshiba Silicone Co., Ltd.), 50 parts of 2-methoxy-1-propanol, and 50 parts of methanol were placed in a ball mill, and subjected to a dispersion treatment for 20 hours to prepare a coating liquid for a conductive layer. The coating liquid for a conductive layer was applied onto the support by dip coating, and the resultant coat was heated at 140° C. for 1 hour to be cured, to thereby form a conductive layer having a thickness of 15 am.

Next, 10 parts of copolymer nylon (product name: Amilan CM8000, manufactured by Toray Industries, Inc.) and 30 parts of a methoxymethylated 6-nylon resin (product name: TORESIN EF-30T, manufactured by Teikoku Kagaku Sangyo K.K.) were dissolved in a mixed solvent of 400 parts of methanol and 200 parts of n-butanol to prepare a coating liquid for an undercoat layer. The coating liquid for an undercoat layer was applied onto the conductive layer by dip coating, and the resultant coat was dried at 100° C. for 30 minutes to form an undercoat layer having a thickness of 0.45 μm.

Next, 20 parts of a hydroxygallium phthalocyanine crystal of a crystal form having strong peaks at Bragg angles 20±0.2° in CuKα characteristic X-ray diffraction of 7.4° and 28.2° (charge-generating substance), 0.2 part of a calixarene compound represented by the following structural formula (A), (A)

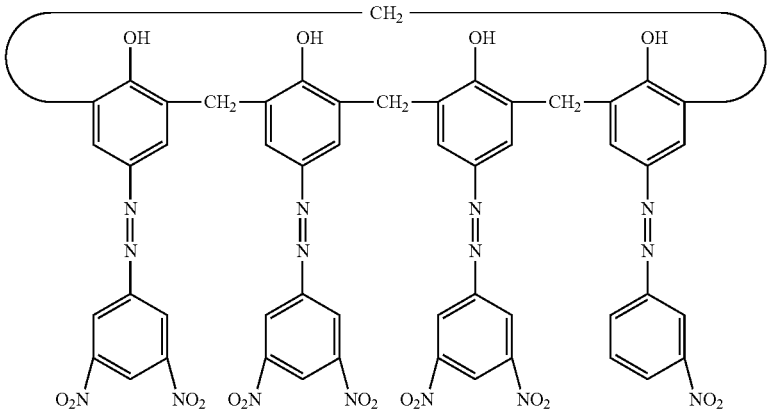

10 parts of polyvinyl butyral (product name: S-LEC BX-1, manufactured by Sekisui Chemical Co., Ltd.), and 600 parts of cyclohexanone were placed in a sand mill using glass beads each having a diameter of 1 mm. Then, the contents were subjected to a dispersion treatment for 4 hours, and then 700 parts of ethyl acetate was added to prepare a coating liquid for a charge-generating layer. The coating liquid for a charge-generating layer was applied onto the undercoat layer by dip coating, and the resultant coat was dried at 80° C. for 15 minutes to form a charge-generating layer having a thickness of 0.17 am.

Next, 30 parts of a compound (charge-transportable compound (hole-transportable compound)) represented by the following structural formula (B), 60 parts of a compound (charge-transportable compound (hole-transportable compound)) represented by the following structural formula (C), 10 parts of a compound (charge-transportable compound (hole-transportable compound)) represented by the following structural formula (D), 100 parts of a polycarbonate resin (product name: Iupilon Z400, manufactured by Mitsubishi Engineering-Plastics Corporation, bisphenol Z-type polycarbonate), and 0.02 part of polycarbonate having two structural units represented by the following formula (E) (viscosity-average molecular weight Mv: 20,000) were dissolved by being mixed with 271 parts of o-xylene, 256 parts of methyl benzoate, and 272 parts of dimethoxymethane (methylal). The solution was applied onto the charge-generating layer by dip coating, and the resultant coat was dried at 120° C. for 50 minutes to form a charge-transporting layer having a thickness of 18 am.

(B)

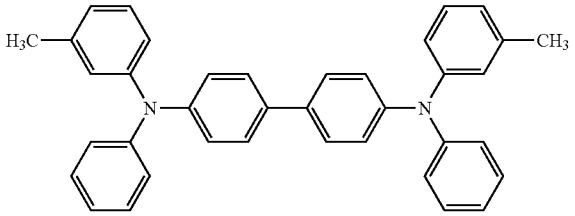

(C)

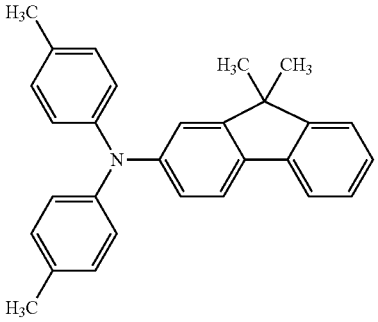

(D)

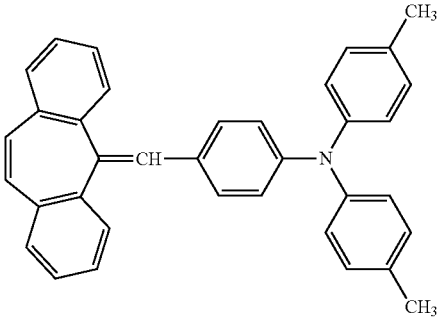

-continued (E)

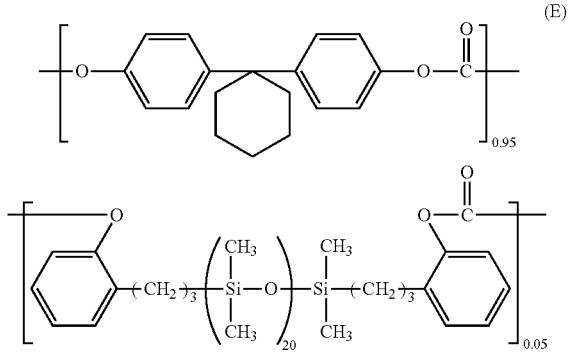

Next, the coating liquid 1 for a protective layer was applied onto the charge-transporting layer by dip coating, and the resultant coat was dried at 50° C. for 5 minutes. After the drying, under a nitrogen atmosphere, the coat was irradiated with electron beams under the conditions of an acceleration voltage of 60 kV and an absorbed dose of 8,000 Gy for 1.6 seconds. An oxygen concentration during a time period from the irradiation with electron beams to a heating treatment for 1 minute was 20 ppm. After that, under a nitrogen atmosphere, the temperature was increased from 25° C. to 110° C. over 10 seconds. Next, in the atmosphere, the coat was subjected to a heating treatment in a drying furnace at 100° C. for 10 minutes to form a protective layer having a thickness of 5 am. The resultant electrophotographic photosensitive member is referred to as "photosensitive member 1".

Next, the surface layer was cut into a piece measuring 10 mm square at a position of 180 mm from an upper end of the resultant photosensitive member 1. The section was subjected to PtPd sputtering from its surface side, and then protected with a photocurable resin and a cover glass. A sample was produced using an ion beam irradiation apparatus (IM4000, manufactured by Hitachi High-Technologies Corporation).

With the use of a scanning electron microscope (SU8220, manufactured by Hitachi High-Technologies Corporation), the cross-section of the surface layer was observed, and an image thereof was taken and binarized (Photoshop CS, manufactured by Adobe). (Smα)/(Sα) and (Sm'α)/(Sα) were calculated based on the resultant image. The results are shown in Table 3.

Production Examples of Photosensitive Member 2 to Photosensitive Member 24

Electrophotographic photosensitive members were all produced in the same manner as in the production example of the photosensitive member 1 except that coating liquids for protective layers shown in Table 3 were used and the protective layer thickness was adjusted to be as shown in Table 3. The resultant electrophotographic photosensitive members are referred to as "photosensitive member 2 to photosensitive member 24." Details are shown in Table 3.

Production Examples of Photosensitive Member 101 and Photosensitive Member 102

Electrophotographic photosensitive members 101 and 102 were all produced in the same manner as in the production example of the photosensitive member 1 except that coating liquids for protective layers shown in Table 3 were used and the protective layer thickness was adjusted to be as shown in Table 3. Details are shown in Table 3.

Production Example of Photosensitive Member 103

The same procedure as that of the production example of the photosensitive member 1 was performed until the formation of the charge-transporting layer. After that, the coating liquid 103 for a protective layer was applied by dip coating, and drying of the solvent was performed at 80° C. for 10 minutes. After the drying, the dried coat on the conductive support was irradiated with UV light at a UV dose of 3,000 mJ/cm$^2$ using a metal halide lamp (product name: M08-L41C, Iwasaki Electric Co., Ltd.) to cure the photocurable resin in the dried coat to form a protective layer having a thickness of 3 am. Thus, an electrophotographic photosensitive member 103 was produced. The UV dose of 3,000 mJ/cm$^2$ was achieved by controlling the irradiation intensity in the range of from 250 W/cm$^2$ to 300 W/cm$^2$ and adjusting the irradiation time in the range of from 120 seconds to 180 seconds, while rotating the conductive support at a position at a distance from the metal halide lamp in the range of from 15 cm to 20 cm.

[Evaluation]

(Evaluation of Photosensitive Member 1)

The photosensitive member 1 was mounted onto a cyan station of a reconstructed machine of an electrophotographic apparatus (copying machine) manufactured by Canon Inc. (product name: imageRUNNER (trademark) ADVANCE C5560) serving as an evaluation apparatus. Under a 10° C./5% RH environment, the conditions of a charging device and an image exposing device were set so that the electrophotographic photosensitive member placed in the cyan station of the evaluation apparatus had a dark portion potential (Vd) of −700 V and a light portion potential (Vl) of −200 V. Thus, the initial potentials of the electrophotographic photosensitive member were adjusted in advance.

Under the above-mentioned conditions, an evaluation chart of A4 lateral 5% image was output on 100,000 sheets in a 5-sheet intermittent manner. After that, the thickness of the protective layer of the photosensitive member used was measured using a multichannel spectroscope (product name: MPCD9800/916C, manufactured by Otsuka Electronics Co., Ltd.) to measure a decrease in thickness (abrasion amount due to long-term use). The abrasion amount was 0.33 am. Subsequently, a halftone image having a cyan density of 30% formed by a screen pattern was output, and through a comparison with the photosensitive member, the presence or absence of an image defect resulting from a deep flaw on the photosensitive member was judged. The results are shown in Table 3.

(Evaluation of Photosensitive Member 2 to Photosensitive Member 24)

In all cases, evaluation was performed in the same manner as in the evaluation of the photosensitive member 1 except that electrophotographic photosensitive members shown in Table 3 were used. The results are shown in Table 3.

(Evaluation of Photosensitive Member 101 to Photosensitive Member 103)

In all cases, evaluation was performed in the same manner as in the evaluation of the photosensitive member 1 except that electrophotographic photosensitive members shown in Table 3 were used. The results are shown in Table 3. For ranks, evaluation was performed as described below.

(Abrasion Amount)

A: Less than 0.4 μm

B: 0.4 μm or more and less than 0.7 μm

C: 0.7 μm or more and less than 0.8 μm

D: 0.8 μm or more and less than 1.0 μm

E: 1.0 μm or more (Image Failure Due to Deep Flaw)

A: A flaw on the photosensitive member does not appear as an image failure, or is so insignificant as to be at a level at which there is no problem with image quality.

B: A flaw on the photosensitive member appears as an image failure.

TABLE 3

| Coating liquid | | | Photosensitive member | | | | Evaluation | | |
|---|---|---|---|---|---|---|---|---|---|
| Coating liquid No | Composite particles Kind | Composite particles Parts | Photosensitive member No | (Smα)/(Sα) | (Sm'α)/(Sα) | Protective layer thickness [μm] | Abrasion amount | Rank | Image failure due to deep flaw |
| 1 | H1 | 5 | 1 | 0.6 | 0.4 | 6 | 0.33 | A | A |
| 2 | H2 | 5 | 2 | 0.6 | 0.4 | 6 | 0.35 | A | A |
| 3 | H3 | 5 | 3 | 0.5 | 0.3 | 6 | 0.32 | A | A |
| 4 | H4 | 5 | 4 | 0.5 | 0.3 | 6 | 0.54 | B | A |
| 5 | H5 | 5 | 5 | 0.5 | 0.3 | 6 | 0.51 | B | A |
| 6 | H6 | 5 | 6 | 0.7 | 0.5 | 6 | 0.31 | A | A |
| 7 | H7 | 5 | 7 | 0.7 | 0.5 | 6 | 0.38 | A | A |
| 8 | H8 | 5 | 8 | 0.7 | 0.5 | 6 | 0.56 | B | A |
| 9 | H9 | 5 | 9 | 0.7 | 0.5 | 6 | 0.51 | B | A |
| 10 | H10 | 5 | 10 | 0.6 | 0.4 | 6 | 0.32 | A | A |
| 11 | H11 | 5 | 11 | 0.5 | 0.3 | 6 | 0.61 | B | A |
| 12 | H12 | 5 | 12 | 0.6 | 0.5 | 6 | 0.33 | A | A |
| 13 | H13 | 5 | 13 | 0.7 | 0.5 | 6 | 0.57 | B | A |
| 14 | H14 | 5 | 14 | 0.4 | 0.3 | 6 | 0.55 | B | A |
| 15 | H15 | 5 | 15 | 0.3 | 0.1 | 6 | 0.77 | C | A |
| 16 | H16 | 5 | 16 | 0.3 | 0.1 | 6 | 0.81 | D | A |
| 17 | H17 | 5 | 17 | 0.5 | 0.4 | 6 | 0.38 | A | A |
| 18 | H18 | 5 | 18 | 0.5 | 0.3 | 6 | 0.34 | A | A |
| 19 | H19 | 5 | 19 | 0.6 | 0.5 | 6 | 0.32 | A | A |
| 20 | H20 | 5 | 20 | 0.6 | 0.4 | 6 | 0.31 | A | A |
| 21 | H21 | 5 | 21 | 0.3 | 0.1 | 8 | 0.72 | C | A |
| 22 | H22 | 5 | 22 | 0.8 | 0.7 | 6 | 0.32 | A | A |

TABLE 3-continued

| Coating liquid | | | Photosensitive member | | | | Evaluation | | |
|---|---|---|---|---|---|---|---|---|---|
| Coating liquid No | Composite particles Kind | Composite particles Parts | Photosensitive member No | (Smα)/(Sα) | (Sm'α)/(Sα) | Protective layer thickness [μm] | Abrasion amount | Rank | Image failure due to deep flaw |
| 1 | H1 | 5 | 23 | 0.5 | 0.2 | 6 | 0.56 | B | A |
| 2 | H2 | 5 | 24 | 0.6 | 0.2 | 6 | 0.67 | B | A |
| 101 | — | — | 101 | 0.2 | — | 6 | 1.14 | E | B |
| 102 | — | — | 102 | 0.1 | — | 6 | 1.00 | E | B |
| 103 | — | — | 103 | 0.2 | — | 3 | 1.12 | E | B |

As described by way of the embodiments and Examples, according to one aspect of the present disclosure, the electrophotographic photosensitive member having higher wear resistance can be provided.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2019-010493, filed Jan. 24, 2019, which is hereby incorporated by reference herein in its entirety.

What is claimed is:

1. An electrophotographic photosensitive member, comprising:

a support bearing a charge-generating layer and a charge-transporting layer, wherein a surface layer of the electrophotographic photosensitive member contains inorganic particles (α) having an average particle diameter (Lα) of primary particles of 5 to 50 nm and resin particles (β) having an average particle diameter (Lβ) of primary particles of 0.1 to 5.0 μm, (Smα)/(Sα)≥0.3 in any cross-section of the surface layer, where a region within (Lβ/2) from a surface of each of the resin particles (β) is defined as a region (M), a sum of cross-sectional areas of the inorganic particles (α) that are present in the cross-section is represented by (Sα), and a sum of cross-sectional areas of the inorganic particles (α) that are included in the region (M) is represented by (Smα), inorganic particles (α) are selected from the group consisting of silica particles and alumina particles, the inorganic particles (α) in the surface layer each have a surface treated with a silicone oil or at least one compound selected from compounds represented by formulae (1) and (2)

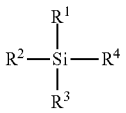

(1)

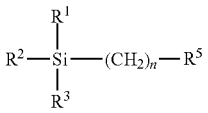

(2)

where $R^1$ to $R^3$ independently represent an alkoxy group or an alkyl group provided that at least two of $R^1$ to $R^3$ represent an alkoxy group, $R^4$ represents a vinyl group, a 1-methylvinyl group, acryloyloxy group or a methacryloyloxy group, $R^5$ represents are acryloyloxy group or a methacryloyloxy group, and n represents an integer of 1 to 6, and the average particle diameter (Lβ) of primary particles is 0.1 to 1.5 μm.

2. The electrophotographic photosensitive member according to claim 1, wherein the resin particles (Lβ) comprise particles of a resin selected from the group consisting of a fluorine resin and a polymethyl methacrylate resin.

3. The electrophotographic photosensitive member according to claim 1, wherein in at cross-section of the surface layer (Smα)/Sα)≥0.5.

4. The electrophotographic photosensitive member according to claim 1, wherein (Sm'α)/(Sα)≥0.3, where a region within (Lβ/3) from the surface of each of the resin particles (β) is defined as a region (M'), the sum of cross-sectional areas of the inorganic particles (α) that are present in the any cross-section of the surface layer is represented by (Sα), and a sum of cross-sectional areas of the inorganic particles (α) that are included in the region (M') is represented by (Sm'α).

5. A process cartridge, comprising:

electrophotographic photosensitive member; and at least one unit selected from the group consisting of a charging unit, a developing unit and a cleaning unit, the process cartridge integrally supporting the electrophotographic photosensitive member and the at least one unit, and being removably mounted onto a main body of an electrophotographic apparatus, wherein the electrophotographic photosensitive member includes a support bearing a charge-generating layer and a charge-transporting layer, a surface layer of the electrophotographic photosensitive member contains inorganic particles (α) having an average particle diameter (Lα) of primary particles of 5 to 50 nm and resin particles (β) having an average particle diameter (Lβ) of primary particles of 0.1 to 5.0 μm, (Smα)/(Sα)≥0.3 in any cross-section of the surface layer, where a region within (Lβ/2) from a surface of each of the resin particles (β) is defined as a region (M), a sum of cross-sectional areas of the inorganic particles (α) that are present in the cross-section is represented by (Sα), and a sum of cross-sectional areas of the inorganic particles (α) that are included in the region (M) is represented by (Smα), inorganic particles (α) are selected from the group consisting of silica particles and alumina particles, the inorganic particles in the surface layer each have a surface treated with a silicone oil or at least one compound selected from compounds represented by formulae (1) and (2)

(1)

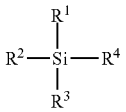

(2)

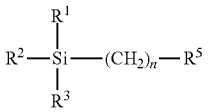

where $R^1$ to $R^3$ independently represent an alkoxy group or an alkyl group provided that at least two of $R^1$ to $R^3$ represent an alkoxy group, $R^4$ represents a vinyl group, a 1-methylvinyl group, an acryloyloxy group or a methacryloyloxy group, $R^5$ represents an acryloyloxy group or a methacryloyloxy group, and n represents an integer of 1 to 6, and the average particle diameter (Lβ) of primary particles is 0.1 to 1.5 μm.

6. Ari electrophotographic apparatus, comprising:

an electrophotographic photosensitive member; and at least one unit selected from the group consisting of a charging unit, an exposing unit, a developing unit, and a transferring unit, wherein the electrophotographic photosensitive member includes a support bearing a charge-generating layer and a charge-transporting layer, a surface layer of the electrophotographic photosensitive member contains inorganic particles (α) having an average particle diameter (Lα) of primary particles of 5 to 50 nm and resin particles (β) having an average particle diameter (Lβ) of primary particles of 0.1 to 5.0 μm, (Smα)/(Sα)≥0.3 in any cross-section of the surface layer, where a region within (Lβ/2) from a surface of each of the resin particles (β) is defined as a region (M), a sum of cross-sectional areas of the inorganic particles (α) that are present in the cross-section is represented by (Sα), and a SUM across-sectional areas of the inorganic particles (α) that are included in the region (M) is represented by (Smα), inorganic particles (α) are selected from the group consisting of silica particles and alumina particles, the inorganic particles (α) in the surface layer each have a surface treated with a silicone oil or at least one compound selected from compounds represented by formulae (1) and (2)

(1)

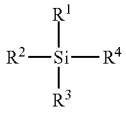

(2)

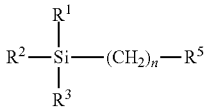

where $R^1$ to $R^3$ independently represent an alkoxy group or an alkyl group provided that at least two of $R^1$ to $R^3$ represent an alkoxy group $R^4$ represents a vinyl group, a 1-methylvinyl group, an acryloyloxy group or a methacryloyloxy group, $R^5$ represents an acryloyloxy group or a methacryloyloxy group, and n represents an integer of 1 to 6, and the average particle diameter (Lβ) of primary particles is 0.1 to 1.5 μm.

* * * * *